US006189159B1

(12) United States Patent
Bailey et al.

(10) Patent No.: US 6,189,159 B1
(45) Date of Patent: Feb. 20, 2001

(54) CHILD SEATING SYSTEM

(76) Inventors: Pamela R. Bailey; Robert D. Bailey, both of 4069 Alder Glen Way, Greenwood, CA (US) 95635

( * ) Notice: Under 35 U.S.C. 154(b), the term of this patent shall be extended for 427 days.

(21) Appl. No.: 08/676,623

(22) Filed: Jul. 10, 1996

(51) Int. Cl.[7] ..... A47K 13/06
(52) U.S. Cl. ..... 4/235
(58) Field of Search ..... 4/235

(56) References Cited

U.S. PATENT DOCUMENTS 54,480 * 5/1866 Alexander ..... 4/235
4,451,940 * 6/1984 Grunz ..... 4/234
5,448,781 * 9/1995 Miller ..... 4/235

FOREIGN PATENT DOCUMENTS

124022 * 5/1947 (AU) ..... 4/235

* cited by examiner

*Primary Examiner*—Robert M. Fetsuga

(57) ABSTRACT

The child seating system relates to a toilet seating system for use by both adults and children. This seating system is adapted for use upon an existing commode assembly. In its broadest context, the present invention includes an adult seat, a child seat, and a lid all of which are pivotally coupled to one another and to the commode assembly. Additionally, a locking mechanism included to lockingly engage with lid with the child seat. With such a locking mechanism the seating system can be use in a conventional manner until the child seat is needed.

1 Claim, 3 Drawing Sheets

CHILD SEATING SYSTEM

BACKGROUND OF THE INVENTION

1. Field of the Invention

The present invention relates to child seating system and more particularly pertains to such a system with a child seat and an adult seat.

2. Description of the Prior Art

The use of dual size toilet seats is known in the prior art. More specifically, dual size toilet seats heretofore devised and utilized for the purpose of accommodating either children or adults are known to consist basically of familiar, expected, and obvious structural configurations, notwithstanding the myriad of designs encompassed by the crowded prior art which has been developed for the fulfillment of countless objectives and requirements.

By way of example, U.S. Des. Pat. No. 309,176 to Sessions discloses a combination adult and child toilet seat and cover. U.S. Pat. No. 5,136,731 to Caro et al. discloses a toilet seat adapter. U.S. Pat. No. 4,635,303 to Shih discloses a foldable toilet seat for children. U.S. Pat. Des. No. 326,316 to Zhang discloses a combination dual size toilet seat and cover. U.S. Pat. Des. No. 324,906 to Barnett discloses a toilet training seat for children. Lastly, U.S. Pat. Des. No. 305,357 to Ritzer discloses a combination adult and child toilet seat and cover.

In this respect, the child seating system according to the present invention substantially departs from the conventional concepts and designs of the prior art, and in doing so provides an apparatus primarily developed for the purpose of providing a child seat which can be locked into a lid portion.

Therefore, it can be appreciated that there exists a continuing need for new and improved child seating system which can be used for either a child or an adult. In this regard, the present invention substantially fulfills this need.

SUMMARY OF THE INVENTION

In view of the foregoing disadvantages inherent in the known types of dual size toilet seats now present in the prior art, the present invention provides an improved child seating system. As such, the general purpose of the present invention, which will be described subsequently in greater detail, is to provide a new and improved child seating system and method which has all the advantages of the prior art and none of the disadvantages.

To attain this, the present invention essentially comprises a toilet seating system for use by adults and children upon a commode assembly. The seating system includes a substantially circular adult seat having a rearward extent, a forward extent, a first side and a second side, a rounded upper surface and a planar lower surface. A plurality of pads are positioned upon the first and second sides of the lower surface. Additionally, a first and second adult seat mounting bracket are integral with the rearward extent, with each of the adult seat mounting brackets having an aperture formed therethrough. An aperture is centrally formed within the adult seat and serves to define an annulus having a width. The system also includes a substantially circular child seat having a rearward extent, a forward extent, a first side, a second side, and a rounded upper surface having a lower periphery, and a concave lower surface. A plurality of pads are positioned upon the first and second sides of the lower surface. A first and second child seat mounting bracket are integral with the rearward extent, with each of the child seat mounting brackets having an aperture formed therethrough. An aperture is formed within the child seat and serves to define an annulus having a width. The annulus width of the child seat is substantially larger than the annulus width of the adult seat, with the aperture formed within the child seat being substantially smaller than the aperture centrally formed within the adult seat. A semicircular cut out is formed within the forward extent of the child seat, and a groove extends around the lower periphery of the upper surface. The system also includes a substantially circular lid having a forward extent, a rearward extent, a first side and a second side, an upper rounded surface and a lower concave surface having a periphery. A plurality of pads are positioned upon the first and second sides of the lower surface. A first and second lid mounting bracket are integral with the rearward extent, with each of the lid mounting brackets having an aperture formed therethrough. A ridge extends around the periphery of the lower concave surface. The system also includes a first and second commode mounting bracket. The first lid mounting bracket, the first adult seat mounting bracket, and the first child seat mounting bracket are pivotally coupled to the first commode mounting bracket. The second child seat mounting bracket, the second adult seat mounting bracket, and the second lid mounting bracket are pivotally coupled to the second commode mounting bracket. The pivoting nature of the child seat over the adult seat and the pivoting of the lid over the child seat is such that the ridge of the lid engages the groove of the child seat to thereby lock the lid to the child seat. The cut out formed within the child seat facilitates the separation of the child seat from the lid.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved child seating system which have all the advantages 6*f* the prior art dual size toilet seats and none of the disadvantages.

It is another object of the present invention to provide new and improved child seating system which may be easily and efficiently manufactured and marketed.

It is further object of the present invention to provide new and improved child seating system which are of durable and reliable constructions.

An even further object of the present invention is to provide new and improved child seating system which are susceptible of a low cost of manufacture with regard to both materials and labor, and which accordingly are then susceptible of low prices of sale to the consuming public, thereby making such child seating system economically available to the buying public.

Still yet another object of the present invention is to provide new and improved child seating system which provide in the apparatuses and methods of the prior art some of the advantages thereof, while simultaneously overcoming some of the disadvantages normally associated therewith.

Even still another object of the present invention is to provide a combination child and adult seat wherein the child seat can be locked into a lid component.

Lastly, it is an object of the present invention to provide new and improved toilet seating system for use by both adults and children. This seating system is adapted for use upon an existing commode assembly. In its broadest context, the present invention includes an adult seat, a child seat, and a lid all of which are pivotally coupled to one another and to the commode assembly. Additionally, means are included to lockingly engage with lid with the child seat. With such means the seating system can be use in a conventional manner until the child seat is needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
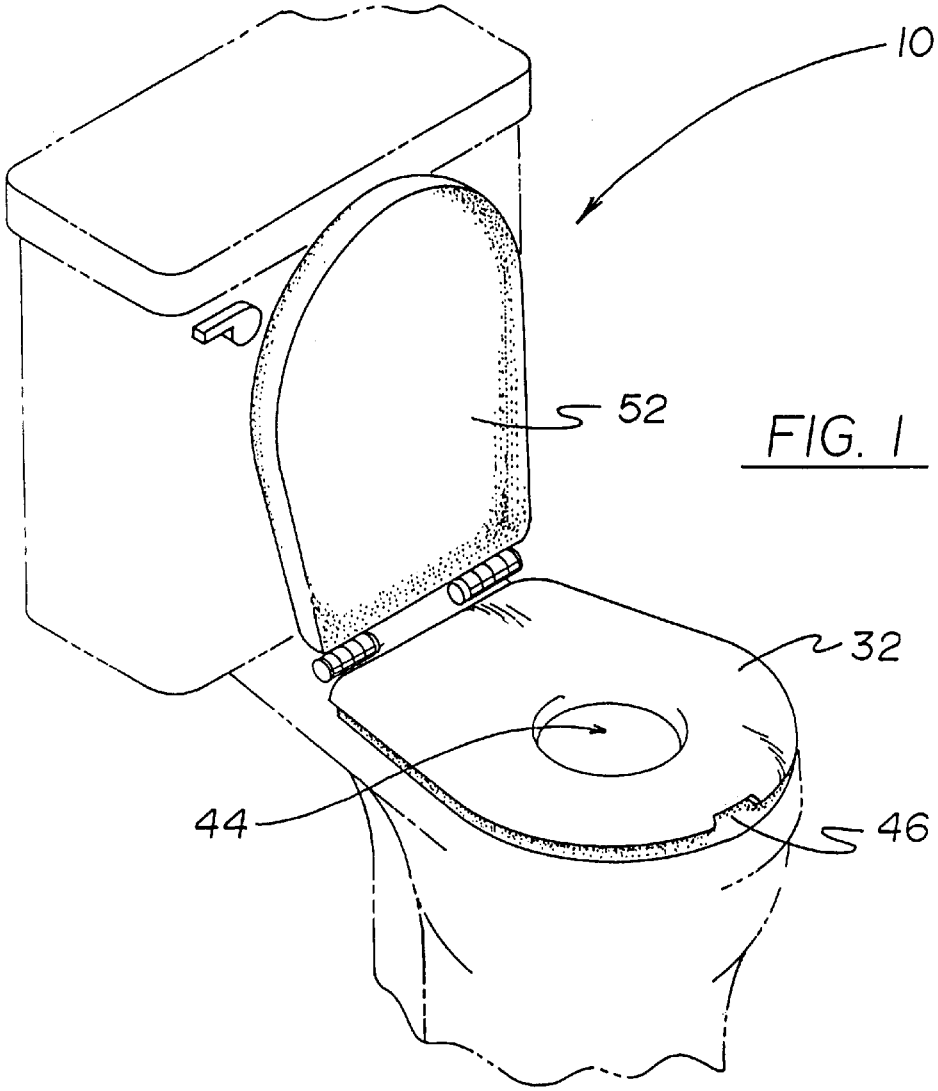
FIG. 1 is a perspective view of the preferred embodiment of the child seating system constructed in accordance with the principles of the present invention.

With reference now to the drawings, and in particular to FIG. 1 thereof, the preferred embodiment of the new and improved child seating system embodying the principles and concepts of the present invention and generally designated by the reference numeral 10 will be described.

The present invention relates to a toilet seating system for use by both adults and children. This seating system is adapted for use upon an existing commode assembly. In its broadest context, the present invention includes an adult seat, a child seat, and a lid all of which are pivotally coupled to one another and to the commode assembly. Additionally, means are included to lockingly engage with lid with the child seat. With such means the seating system can be use in a conventional manner until the child seat is needed. The various components of the present invention, and the manner in which they interrelate, will be described in greater detail hereinafter.

The adult seat 20 is substantially circular in shape and is defined by the following: a rearward extent; a forward extent; a first side; a second side; a rounded upper surface 22; and a planar lower surface 24. A plurality of pads 26 are positioned at spaced locations upon the first and second sides of the lower surface 24. These pads 26 serve as cushioning and protecting as the adult seat 20 contacts the commode assembly.

Figure 5:
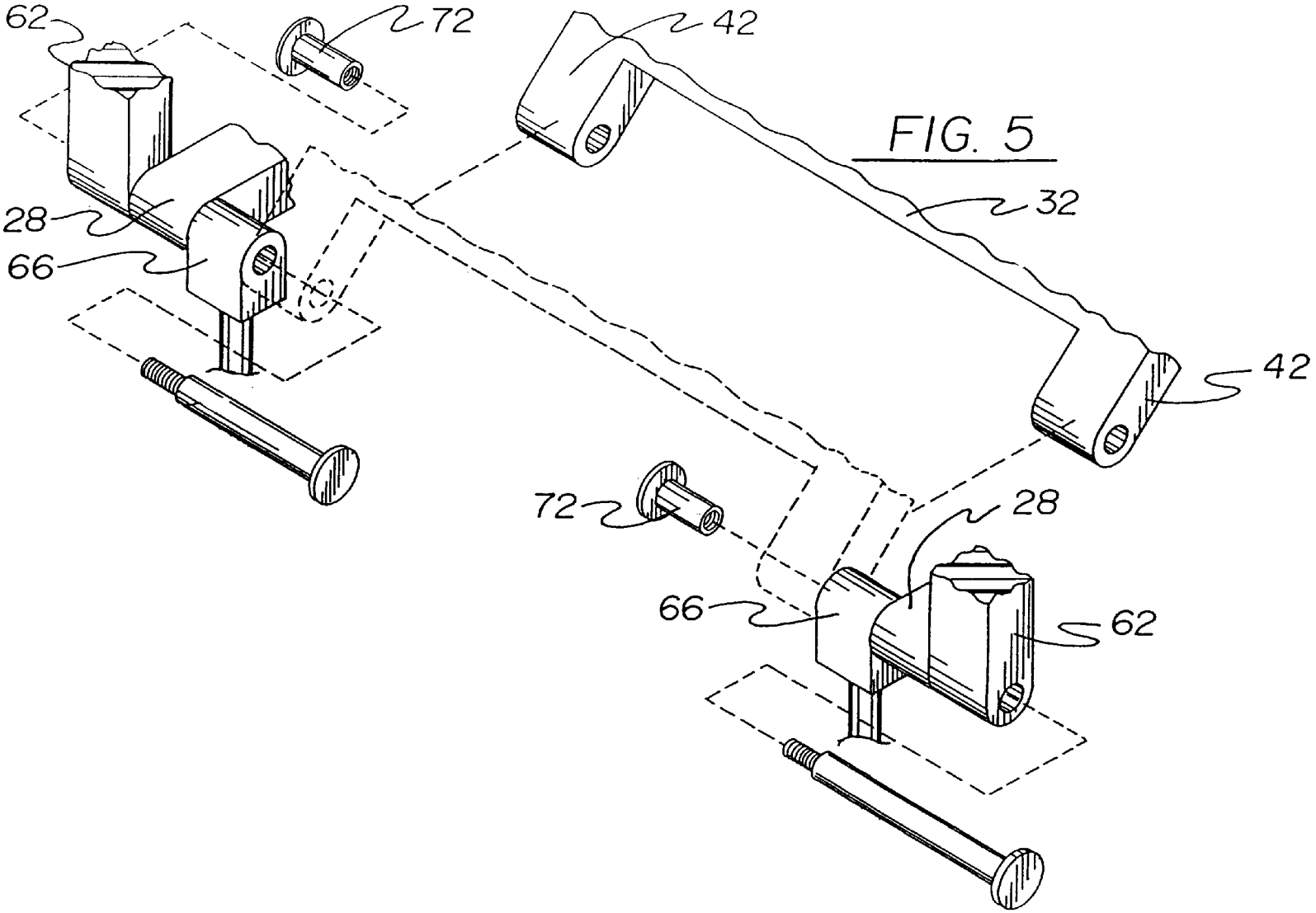
FIG. 5 is an exploded view of a portion of the present invention.

As is best illustrated in FIG. 5, the adult seat 20 includes both a first and second adult seat mounting bracket 28. These brackets are integral with the rearward extent are spaced at the first and second sides respectively. Additionally, each of these adult seat mounting brackets 28 has an aperture formed therethrough. The function of these apertures will be described in greater detail hereinafter. Furthermore, as is illustrated in FIG. 1, an aperture is centrally formed within the adult seat 20. This aperture serves to define an annulus which is defined by a width and has an inherent thickness.

The next component of the seating system is the child seat 32. The child seat 32 enables a younger person to use the commode as an adult. This child seat 32 is substantially circular in shape and is defined by a rearward extent, a forward extent, a first side, a second side, a rounded upper surface 34 having a lower periphery, and a concave lower surface 36. As illustrates in FIG. 4, a groove 48 extends around the lower periphery of the upper surface 34 of the seat. The function of this groove 48 will be described in greater detail hereinafter. As with the adult seat 20, the child seat 32 includes a plurality of pads 38 positioned upon the first and second sides of the lower surface 36. These pads 38 cushion and protect the seating system as the child seat 32 comes into contact with the adult seat 20.

Figure 4:
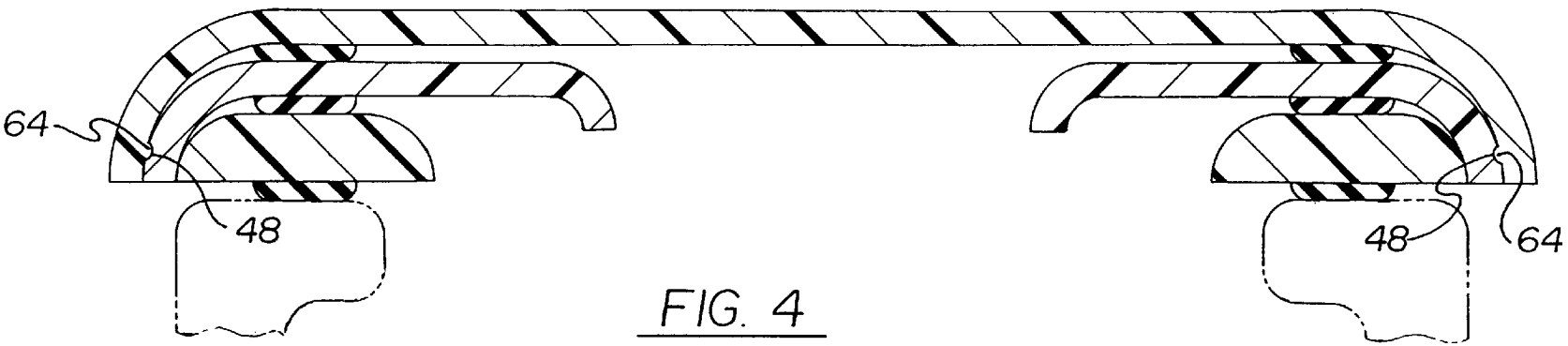
FIG. 4 is a cross sectional view of the first embodiment of the present invention.

The child seat 32 further includes a first and a second child seat mounting bracket 42 each of which is integral with the rearward extent of the child seat 32. The two mounting brackets 42 are spaced at the first and second sides of the seat respectively. The positioning of these mounting brackets 42 is best illustrated in FIG. 5. Each of the child seat mounting brackets 42 has an aperture formed therethrough, the function of which will be hereafter described. As with the adult seat 20, an aperture 44 is formed within the child seat 32. This aperture 44 serves to define an annulus having both a width and a thickness. In comparison with the aperture of the adult seat 20, the aperture 44 of the child seat 32 is substantially smaller and oriented more toward the forward extent of the seat. The size and positioning of the child seat 32 aperture 44 facilitates its use by children. Furthermore, the annulus width of the child seat 32 is substantially larger than the annulus width of the adult seat 20. The relationship between the two widths is best illustrated in FIG. 4. As illustrated in this figure, the inner extent of the child seat 32 extends beyond the adult seat 20. This overhang between the two seats creates a cushioning effect for the child using the system of the present invention. Furthermore, this overhang reduces the chances of a hand getting pinched in between the child and adult seats. Furthermore, as is illustrated in FIG. 1, a semicircular cut out 46 is formed within the forward extent of the child seat 32. The function of this cut out 46 will be described in greater detail hereinafter.

The third component of the seating system is the lid 52. This substantially circular lid 52 has a thickness, a forward extent, a rearward extent, a first side, a second side, an upper rounded surface 54 and a lower concave surface 56 having a periphery. A plurality of pads 58 are positioned upon the first and second sides of the lower surface 56. These pads 58 protect and cushion the lid 52 as it contacts the child seat 32.

With reference to FIG. 5, the lid 52 includes a first and second lid mounting bracket 62. These brackets are integral with the rearward extent and spaced at the first and second sides respectively. Each of the lid mounting brackets 62 has an aperture formed therethrough. Additionally, a ridge 64 extends around the periphery of the lower concave surface 56. The function of this ridge 64 will be described more fully hereinafter.

Figure 2:
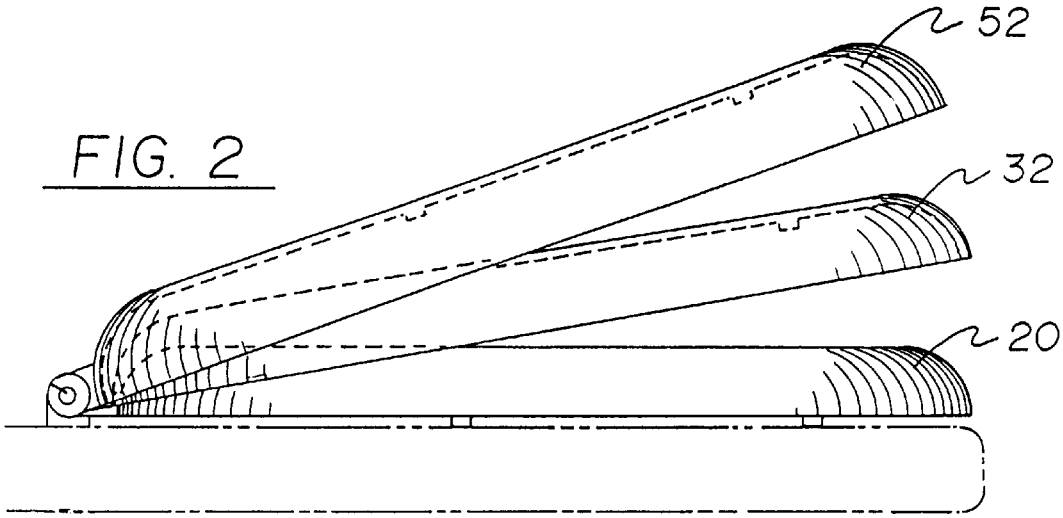
FIG. 2 is a side view of the two seats and lid employed in conjunction with the present invention.
Figure 3:
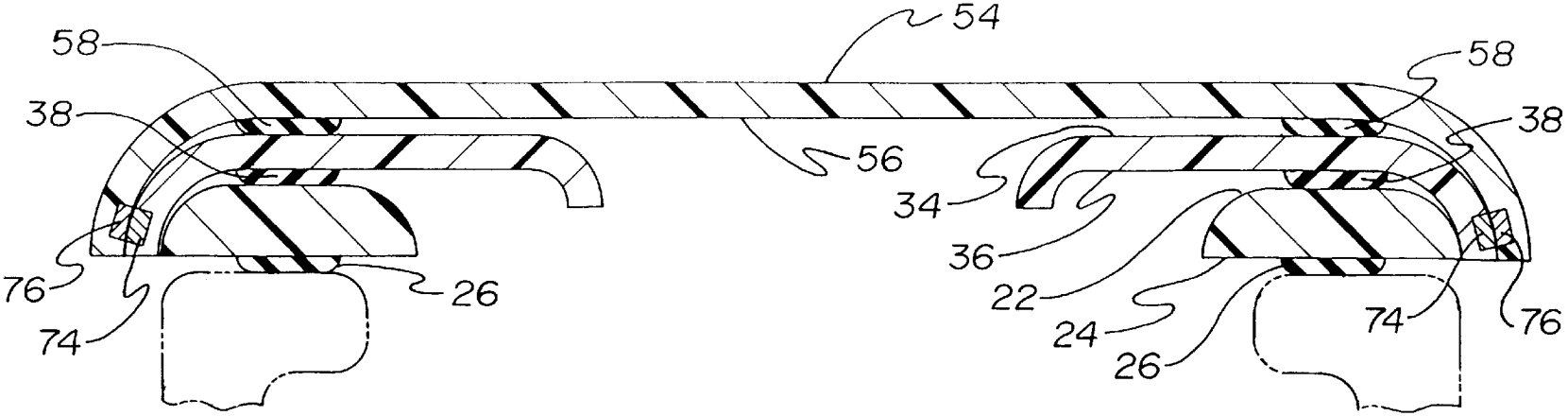
FIG. 3 is a cross sectional view of the second embodiment of the present invention.

A first and second commode mounting brackets 66 are employed in securing the seating assembly of the present invention to the existing commode assembly. The manner in which the commode mounting brackets 66 mount the seating system to the commode assembly can most clearly be seen in reference to FIGS. 2 and 5.

The manner in which the various components of the present invention are interrelated will next be described. An interconnection between the child seat 32, adult seat 20, lid 52 and mounting brackets is achieved through a pivotal coupling. More specifically, the first lid mounting bracket 62, the first adult seat mounting bracket 28, and the first child seat mounting bracket are pivotably coupled to the first commode mounting brackets 66. In addition, the second child seat mounting bracket, the second adult seat mounting bracket 28, and the second lid mounting bracket 62 are pivotably coupled to the second commode mounting bracket. Preferably, the brackets are inseparable thereby preventing vandalism. Additionally, in the first embodiment the ridge 64 of the lid 52 is adapted to engage the groove 48 of the child seat 32 to thereby lock the lid 52 to the child seat 32. This relationship is best illustrated in FIG. 4. Thus, if a user wishes to use the system as an adult seat 20, the lid 52 can be brought into locking engagement with the child seat 32 such that the two elements can be pivoted together. Then, when the user wishes to use the child seat 32, the two seats can be uncoupled. The uncoupling of the two seats is facilitated by the cut out 46 formed within the child seat 32. This cut out 46 provides the user a better grasp when separating the two seats.

In a second embodiment depicted in FIG. 4, a number of magnets assist in lockingly engaging the child seat 32 to the lid 52. In this embodiment the groove 48 formed within the child seat 32 and the ridge 64 formed within the lid 52 are not present. However, a plurality of magnets 74 are positioned within the thickness of the annulus of the child seat 32. Furthermore, a plurality of magnets 76 are positioned within the thickness of the lid 52. The number and position of magnets 76 within the lid 52 correspond to the number and position of magnets 74 within the thickness of the child seat 32. Thus, the magnets 74 within the thickness of the child seat 32 cooperate with the magnets 76 within the thickness of the child seat 32 to keep the lid 52 and child seat 32 locked together. As in the first embodiment, the semicircular cut out 46 within the child seat 32 can be employed in separating the two seats. In the preferred embodiment, two magnets are employed within the lid 52 and two magnets are employed within the child seat 32.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet seating system for use by adults and children upon a commode assembly, the seating system comprising in combination:

a substantially circular adult seat having a rearward extent, a forward extent, a first side and a second side, a rounded upper surface and a planar lower surface, a plurality of pads positioned at spaced locations upon the first and second sides of the lower surface, a first and second adult seat mounting bracket integral with the rearward extent, each of the adult seat mounting brackets having an aperture formed therethrough, an aperture centrally formed within the adult seat serving to define an annulus having a width;

a substantially circular child seat having a rearward extent, a forward extent, a first side, a second side, and a rounded upper surface, and a concave lower surface, a plurality of pads positioned upon the first and second sides of the lower surface, a first and second child seat mounting bracket integral with the rearward extent, each of the child seat mounting brackets having an aperture formed therethrough, an aperture formed within the child seat serving to define, an annulus having a width and a thickness, the annulus width of the child seat being substantially larger than the annulus width of the adult seat, the forward extent of the child seat extending beyond the adult seat thereby defining an overhang that reduces the chance of getting a hand caught between the child and adult seats and further affords a cushing affect, the aperture formed within the child seat being substantially smaller than the aperture centrally formed within the adult seat and oriented more toward the forward extent of the child seat whereby a midpoint of the aperture of the child set is offset with respect to a midpoint of the aperture of the adult seat, a semicircular cut out formed within the forward extent of the child seat, a plurality of magnets positioned within the thickness of the annulus;

a substantially circular lid having a forward extent, a rearward extent, a first side, a second side, a thickness, an upper rounded surface and a lower concave surface, a plurality of pads positioned upon the first and second sides of the lower surface, a first and second lid mounting bracket integral with the rearward extent, each of the lid mounting brackets having an aperture formed therethrough, a plurality of magnets positioned within the thickness of the lid, the number and position of which correspond to the number and position of magnets within the thickness of the child seat;

a first and second commode mounting bracket adapted to secure to the commode assembly, whereby the first lid mounting bracket, the first adult seat mounting bracket, and the first child seat mounting bracket are pivotably coupled to the first commode mounting bracket and the second child seat mounting bracket, the second adult seat mounting bracket, and the second lid mounting bracket are pivotally coupled to the second commode mounting bracket thus permitting the pivoting of the adult seat over the commode assembly, the pivoting of the child seat over the adult seat and the pivoting of the lid over the child seat such that the magnets within the thickens of the child seat cooperate with the magnets within the thickness of the adult set to keep the lid and child seat locked together, the cut out formed within the child seat facilitating the separation of the child seat form the lid.

* * * * *